US006997529B1

(12) United States Patent
Chen et al.

(10) Patent No.: US 6,997,529 B1
(45) Date of Patent: Feb. 14, 2006

(54) SYNCHRONIZING DEVICE FOR A TRI-SECTOR SLIDE

(75) Inventors: Ken-Ching Chen, Kaohsiung Hsien (TW); Shih-Long Hwang, Kaohsiung Hsien (TW); Shun-Ho Yang, Kaohsiung Hsien (TW); Chun-Chiang Wang, Kaohsiung Hsien (TW)

(73) Assignee: King Slide Works Co., Ltd., Kaohsiung Hsien (TW)

( * ) Notice: Subject to any disclaimer, the term of this patent is extended or adjusted under 35 U.S.C. 154(b) by 0 days.

(21) Appl. No.: 11/037,375

(22) Filed: Jan. 19, 2005

(51) Int. Cl.
*A47B 88/04* (2006.01)

(52) U.S. Cl. ..... 312/334.47; 312/334.44

(58) Field of Classification Search ..... 312/330.1, 312/334.1, 334.7, 334.8, 334.11, 334.44, 312/334.46, 334.47; 384/20, 21
See application file for complete search history.

(56) References Cited

U.S. PATENT DOCUMENTS

| | | | | |
|---|---|---|---|---|
| 5,551,775 | A | 9/1996 | Parvin | |
| 5,757,109 | A | 5/1998 | Parvin | |
| 6,375,290 | B1 * | 4/2002 | Lin et al. | 312/334.46 |
| 6,412,891 | B1 * | 7/2002 | Liang et al. | 312/334.44 |
| 2002/0057042 | A1 | 5/2002 | Milligan | |
| 2003/0080659 | A1 | 5/2003 | Judge et al. | |
| 2003/0107309 | A1 | 6/2003 | Lauchner | |
| 2003/0111942 | A1 | 6/2003 | Judge et al. | |
| 2003/0178922 | A1 | 9/2003 | Chen et al. | |

FOREIGN PATENT DOCUMENTS

DE 2707365 * 8/1978

* cited by examiner

*Primary Examiner*—James O. Hansen
(74) *Attorney, Agent, or Firm*—Rosenberg, Klein & Lee

(57) ABSTRACT

A synchronizing device for a tri-sector slide includes a loading rail secured to a fixed rail to load a sliding rail, and is in such an arrangement that the loading rail and the sliding rails are capable of doing linear reciprocal movement with respect to the fixed rail. The loading rail comprises a linking plate at the rear end. The sliding rail comprises a protuberance corresponding to the linking plate. The fixed rail comprises a releasing member. By pulling the sliding rail, the protuberance engages with the linking plate, which brings the loading rail to slide simultaneously. The releasing member pushes the linking plate to swing, which brings the protuberance to detach from the linking plate to allow the sliding rail to extend along the loading rail to its extremity.

3 Claims, 8 Drawing Sheets

SYNCHRONIZING DEVICE FOR A TRI-SECTOR SLIDE

BACKGROUND OF THE INVENTION

1. Field of the Disclosure

This invention relates to a synchronizing device for a tri-sector slide, and more particularly to a sliding rail and a loading rail to slide simultaneously to a predetermined position where the loading rail stops while the sliding rail can continue sliding to its maximum position.

2. Description of the Prior Art

A conventional tri-sector slide on the market includes a fixed rail (outer rail), a loading rail (middle rail) and a sliding rail (inner rail). This design has been derived for many years. The common design is that the loading rail is able to slide along with the sliding rail to the extreme position and to block the sliding rail thereat, as disclosed in U.S. Pat. Nos. 5,551,775; 5,575,109 and published application Nos. 2002/0057042; 2003/0080659; 2003/0107309; 2003/0111942 and 2003/0178922. However, a synchronized movement of a loading rail and a sliding rail still has a lot of field to be modified, which is the reason of this invention.

SUMMARY OF THE INVENTION

It is the primary objective of the present invention to provide a synchronizing device for a tri-sector slide, which allows a loading rail to slide with a sliding rail to a predetermined position and stop the movement of the loading rail while the sliding rail is still movable to its extreme position.

It is another objective of the present invention to provide a synchronizing device for a tri-sector slide, which provides an easy operated closet or drawer rail.

DETAILED DESCRIPTION OF THE PREFERRED EMBODIMENTS

Figure 1:
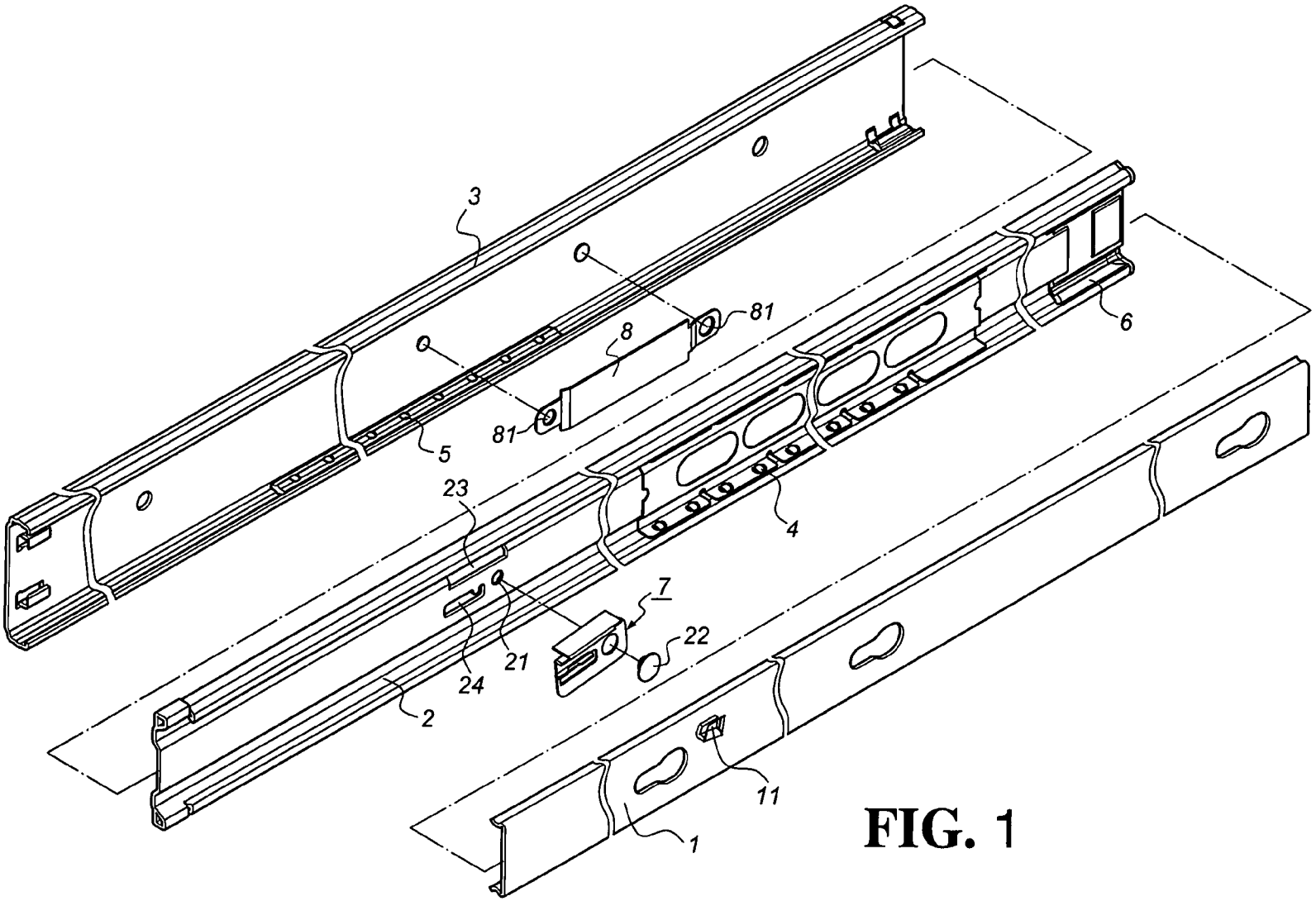
FIG. 1 is an exploded view of a preferred embodiment of the present invention.
Figure 2:
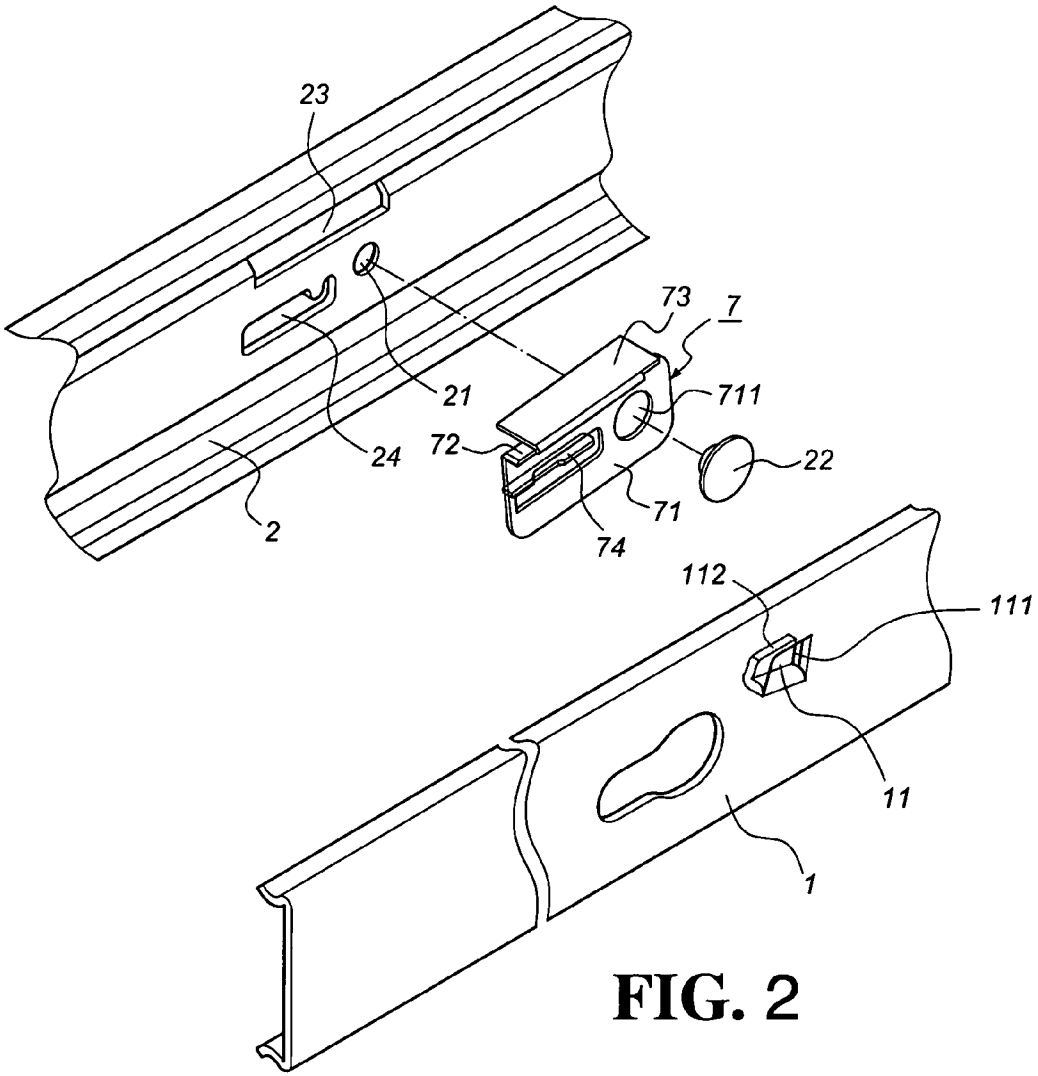
FIG. 2 is an enlarged view of the preferred embodiment of the present invention.
Figure 3:
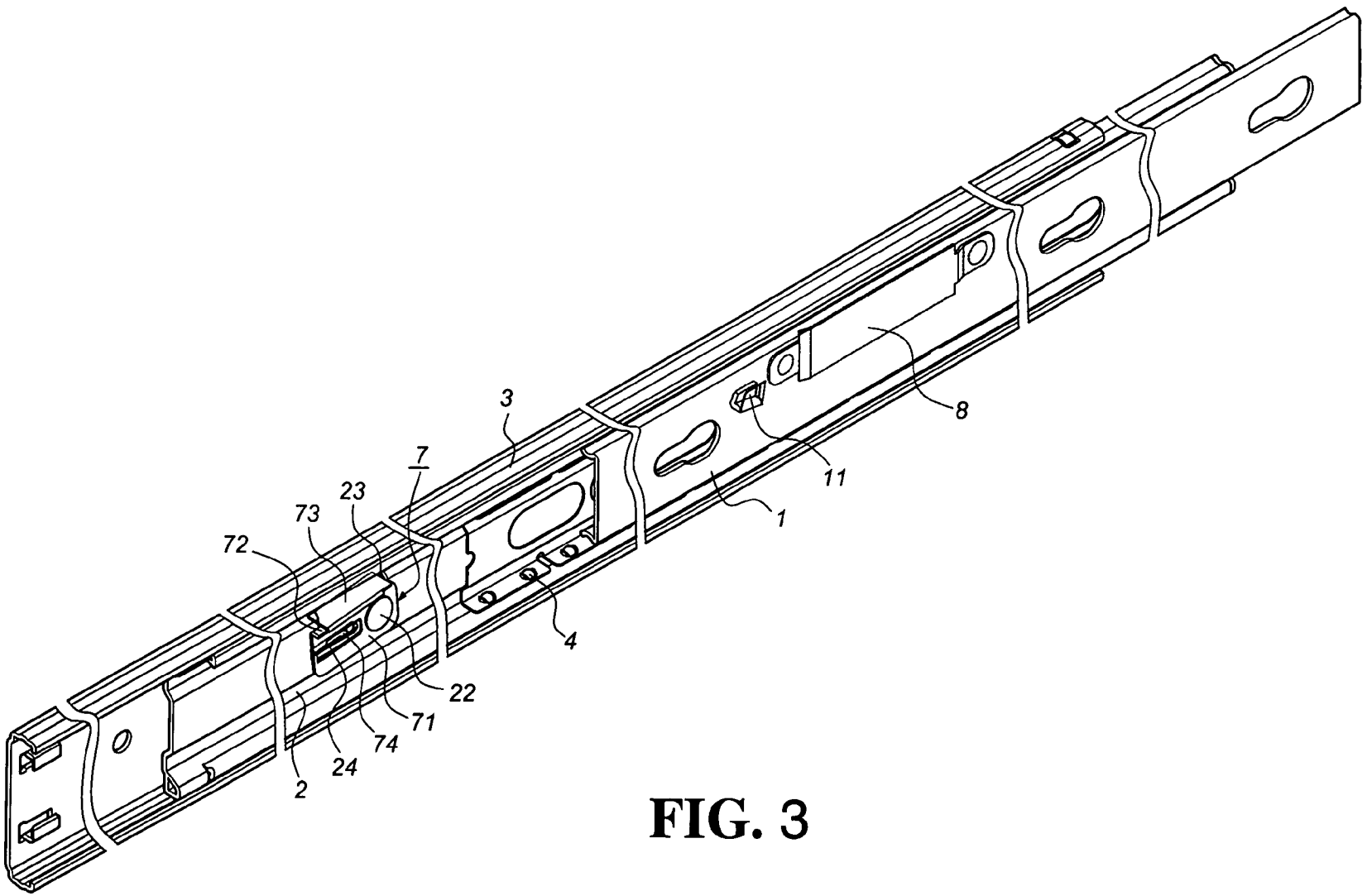
FIG. 3 is a perspective view of the preferred embodiment of the present invention.

As shown in FIGS. 1 through 3, a synchronizing device of the present invention is applied to a tri-sector slide and comprises a sliding rail 1, a loading rail 2 and a fixed rail 3. There are a sliding guide 4 formed between the sliding rail 1 and the loading rail 2 and a sliding guide 5 formed between the loading rail 2 and the fixed rail 3 to facilitate sliding movement. The loading rail 2 comprises a sliding support 6 at the front end.

The sliding rail 1 comprises a protuberance 11 facing inwardly. The protuberance 11 has a stop edge 111 and a guiding edge 112 thereof.

The loading rail 2 is formed with an arcuate surface at center in cross section. The rear end of the arcuate surface is provided with a through hole 21 for a shaft 22 to insert there through. A through trough 23 and a slot 24 are formed close to the through hole 21, so as to connect with a linking plate 7 thereat.

The fixed rail 3 comprises a releasing member 8 at the inner wall. The releasing member 8 is an arcuate plate having two holes 81 at respective ends to engage with the inner wall of the fixed rail 3 in a riveting manner.

The linking plate 7 comprises a flat body 71 flushing with the arcuate surface of the loading rail 2. The flat body 71 has a pivoting hole 711 for the shaft 22 to insert therein. One side of the flat body 71 is bent to form a wall 72 facing upwardly. The wall 72 is bent again from the top edge to form a trigger plate 73 to insert into the through trough 23 of the loading rail 2. The trigger plate 73 has a width larger than that of the linking plate 7. The flat body 71 of the linking plate 7 is formed with an elastic arm 74 to insert into the slot 24 of the loading rail 2 to provide a restoring force to the linking plate 7.

Figure 4:
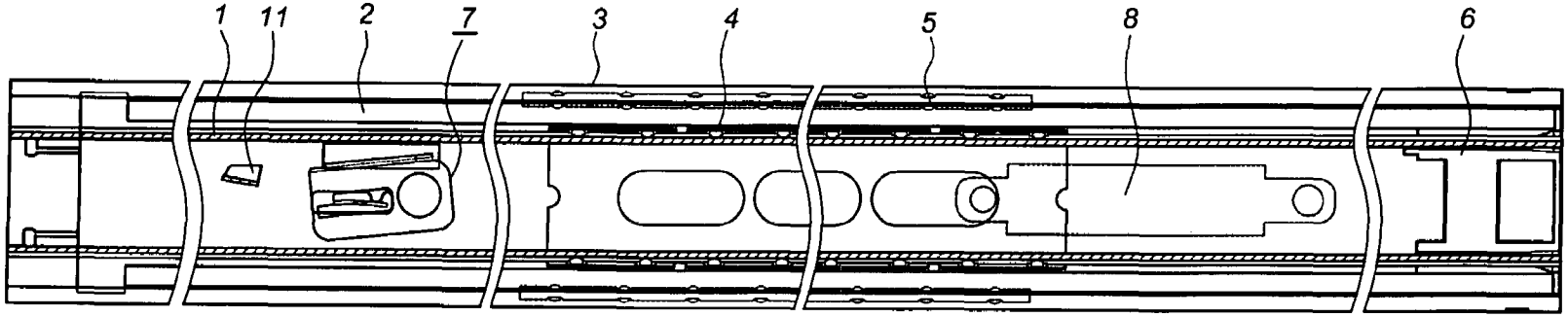
FIG. 4 is a side view showing a collapsed status of the preferred embodiment of the present invention.
Figure 5:
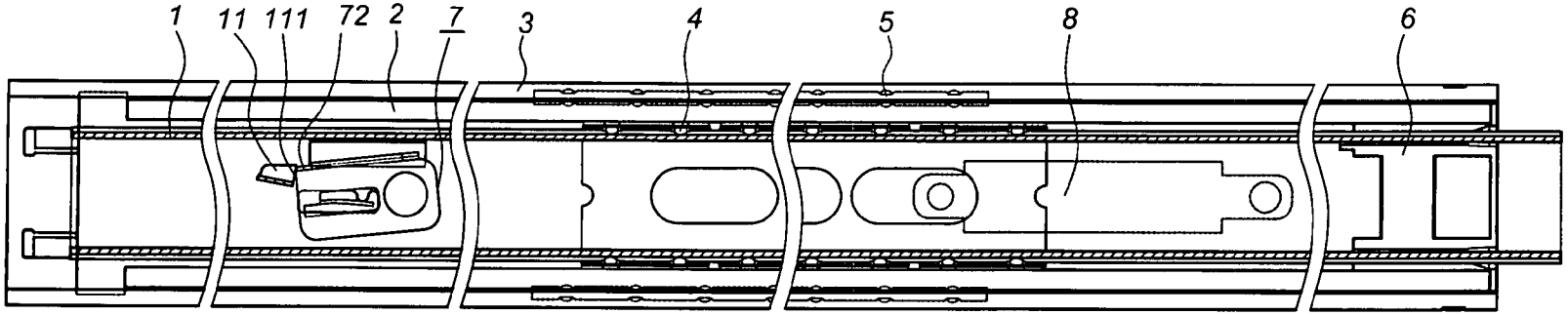
FIG. 5 is a side view showing a loading rail and a sliding rail being pulled outward to a first position.
Figure 6:
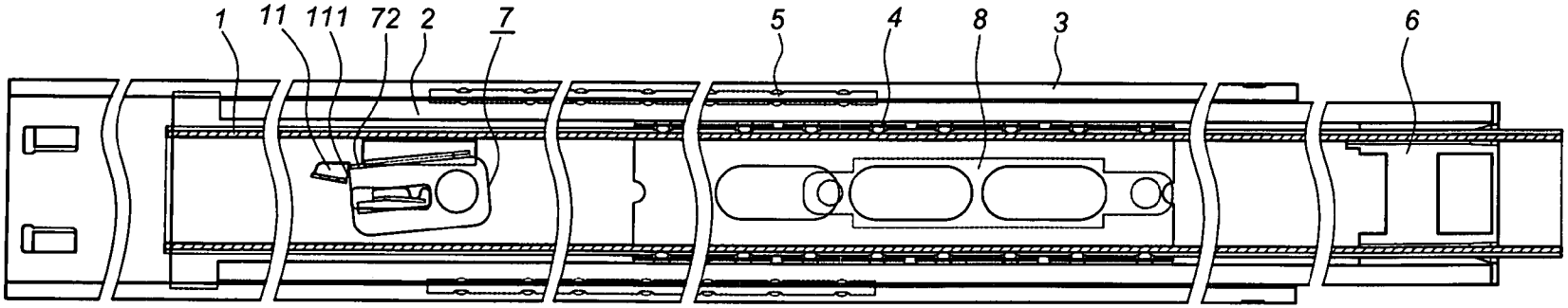
FIG. 6 is a view similar to FIG. 5 showing the loading rail and the sliding rail being pulled outward to a second position.
Figure 7:
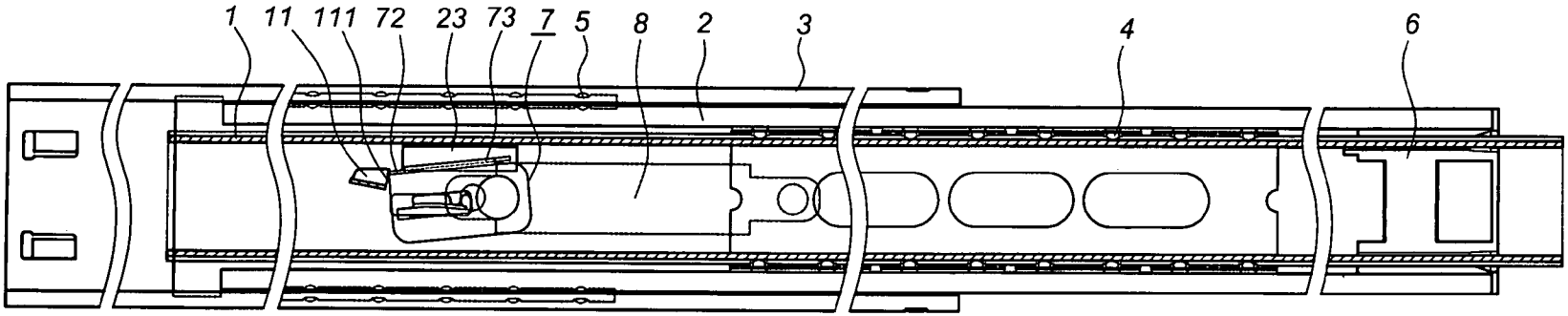
FIG. 7 is a view similar to FIG. 5 showing the loading rail and a sliding rail being pulled outward to a third position.
Figure 8:
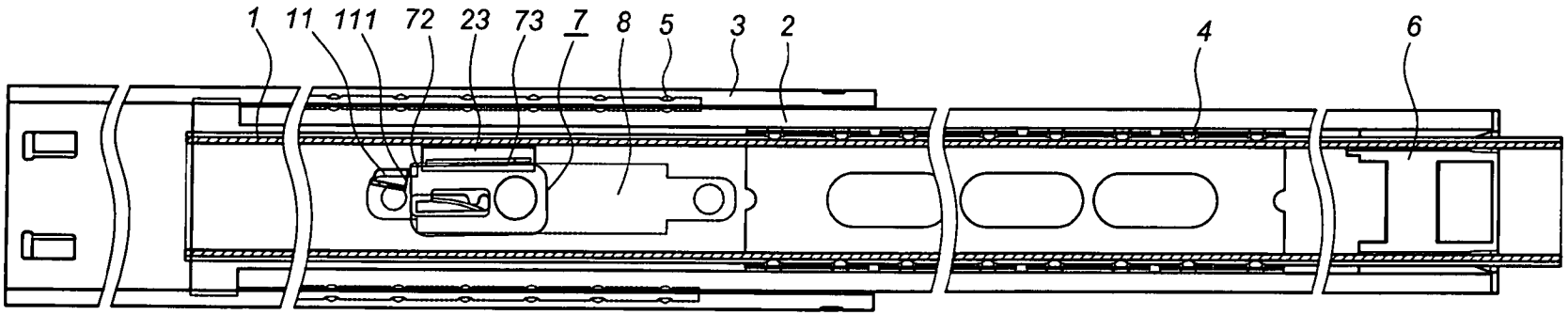
FIG. 8 is a view similar to FIG. 5 showing the loading rail and the sliding rail being pulled outward to a fourth position.
Figure 9:
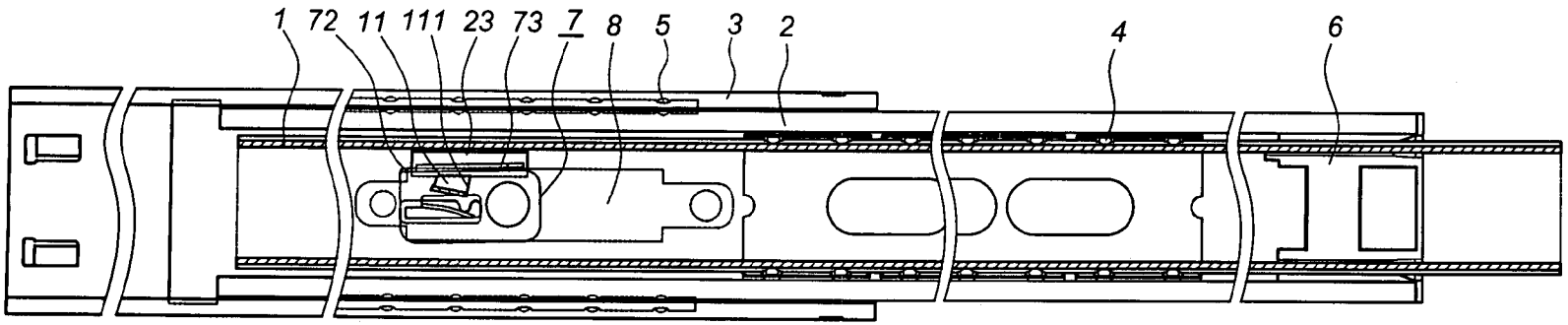
FIG. 9 is a view similar to FIG. 5 showing the loading rail and the sliding rail being pulled outward to a fifth position.
Figure 10:
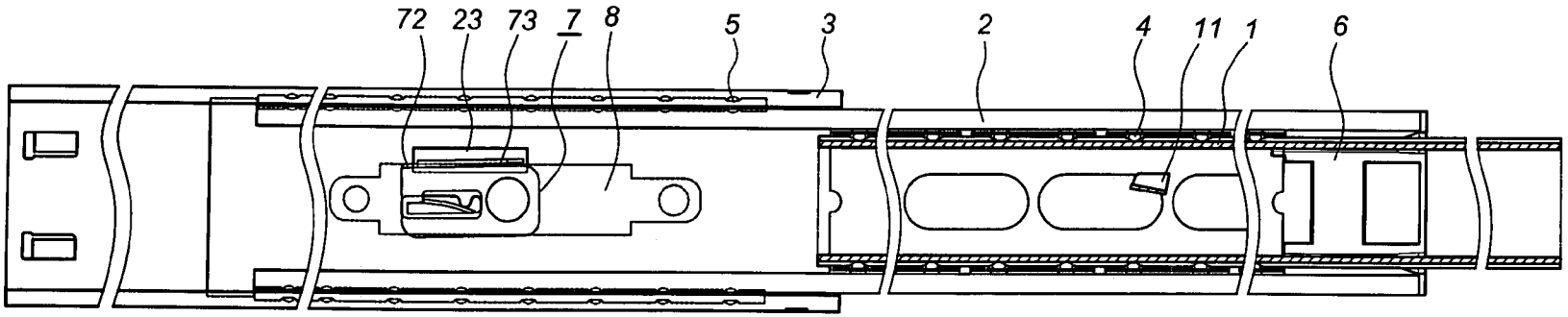
FIG. 10 is a view similar to FIG. 5 showing the loading rail and the sliding rail being pulled outward to its extreme position.

As shown in FIG. 4, when the slide is in a collapsed status, the protuberance 11 of the sliding rail 1 is generally located behind and apart from the linking plate 7 of the loading rail 2. When the sliding rail 1 is pulled outward, as shown in FIGS. 5 and 6, the stop edge 111 of the protuberance 11 of the sliding rail 1 engages with the rear end of the wall 72 of the linking plate 7 to pull the loading rail 2 along therewith. Upon the linking plate 7 reaches to the releasing member 8 of the fixed-plate 3, as shown in FIGS. 7 and 8, the linking plate 7 slides with the trigger 73 protruding from the through trough 23 of the loading rail 2 along the releasing member 8, which causes the linking plate 7 to swing. The stop edge 111 of the protuberance 11 of the sliding rail 1 detaches from the end of the wall 72, thus the sliding rail 1 is able to extend with respect to the loading rail 2, as shown in FIG. 9. Upon the loading rail 2 has reached to its extremity, as shown in FIG. 10, the trigger 73 of the linking plate 7 engages with the releasing member 8, and the protuberance 11 of the sliding rail 1 detaches from the wall 72 of the linking plate 7. Thus the sliding rail 1 is still pulled to its extremity to complete the final extension of the tri-sector slide.

Figure 11:
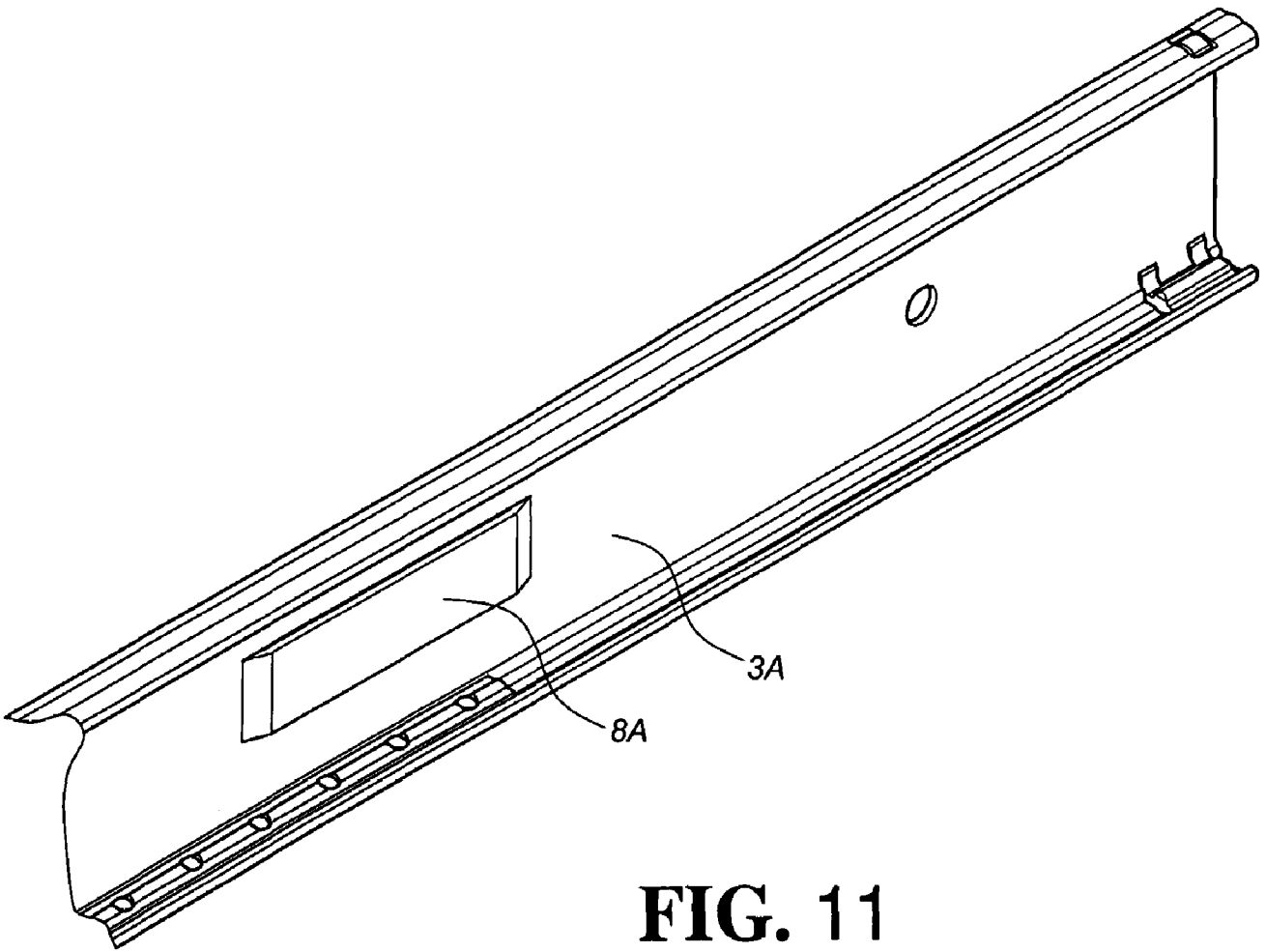
FIG. 11 is a perspective view of another preferred embodiment of the present invention.

As shown in FIG. 11, a fixed rail 3A may be formed with a releasing member 8A integral with the fixed rail 3A. The releasing member 8A is an arcuate plate.

What is claimed is:

1. A synchronizing device for a tri-sector slide comprising:

a sliding rail having a protuberance facing inwardly, said protuberance having a stop edge thereof;

a loading rail having an arcuate surface at center in cross section, a rear end of said arcuate surface being pivotally connected with a linking plate by a shaft, the rear end of said arcuate surface comprising a through trough and a slot;

a fixed rail having an arcuate releasing member at an inner wall;

said linking plate comprising a flat body mounted to said arcuate surface of said loading rail, said flat body having a pivoting hole for insertion of said shaft, one side of said flat body being bent to form a wall facing upwardly, said wall being bent again from its top edge to form a trigger plate to insert into said through trough of said loading rail, said trigger plate having a width larger than that of said linking plate, said flat body being formed with an elastic arm to insert into said slot of said loading rail to provide a restoring force to said linking plate;

thereby said stop edge of said protuberance of said sliding rail engaging with said wall of said linking plate when said sliding rail is pulled to link said loading rail to move simultaneously, and said releasing member pushing said trigger plate to swing said linking plate, which brings said protuberance to detach from said linking plate to allow said sliding rail to extend along said loading rail to its extremity.

2. The synchronizing device for a tri-sector slide, as recited in claim 1, wherein said releasing member is an arcuate plate having holes at respective ends thereof for being engaged with the inner wall of said fixed rail by rivets.

3. The synchronizing device for a tri-sector slide, as recited in claim 1, wherein said releasing member is an arcuate plate integrally formed with said fixed rail.

* * * * *